United States Patent [19]

Chovaniec

[11] 4,313,230

[45] Feb. 2, 1982

[54] BELT FOR A CONCEALED QUICK-DRAW KNIFE

[76] Inventor: Clarence B. Chovaniec, 6447 Amigo Ave., Reseda, Calif. 91335

[21] Appl. No.: 115,768

[22] Filed: Jan. 25, 1980

[51] Int. Cl.[3] ..... A41F 9/00; 24 163 K;164

[52] U.S. Cl. ..... 2/322; 24/163 K; 224/232; 30/162

[58] Field of Search ..... 2/322, 321, 338, 340; 224/232; 30/151, 162

[56] References Cited

U.S. PATENT DOCUMENTS

| | | | |
|---|---|---|---|
| 2,901,823 | 9/1959 | Widen | 30/151 |
| 3,381,807 | 5/1968 | Vaughn | 224/232 |
| 3,823,422 | 6/1974 | Forgett | 2/321 |
| 4,100,655 | 7/1978 | Langley | 2/322 |
| 4,203,167 | 5/1980 | Collins | 2/322 |

FOREIGN PATENT DOCUMENTS

| | | | |
|---|---|---|---|
| 583094 | 9/1959 | Canada | 30/151 |

*Primary Examiner*—Henry Jaudon

*Attorney, Agent, or Firm*—Smyth, Pavitt, Siegemund & Martella

[57] ABSTRACT

A small weapon, such as a short-bladed defensive knife can be innocently concealed in an article of ordinary apparel, such as a belt, according to the present invention in such a manner as to both be securely retained within the article of apparel and be quickly and simply withdrawn by a simple, single motion when needed in instances of self-defense. The weapon is retained within the article of apparel by frictional engagement between the article and the weapon, which is primarily achieved by different curvatures of the holster, which is combined with the article of apparel, and of the weapon. The frictional engagement between the weapon and the holster can be increased by providing additional end clips, protrusions, or other attachments between the weapon and its holster.

12 Claims, 6 Drawing Figures

BELT FOR A CONCEALED QUICK-DRAW KNIFE

BACKGROUND OF THE INVENTION

1. Field of the Invention

The present invention relates to the field of articles of apparel which are arranged and configured to conceal weapons, and in particular the present invention relates to a belt having means for concealing a quick-draw knife.

2. Description of the Prior Art

Sportsmen, soldiers of fortune, weapon collectors, and persons concerned with or having a need for weapons of self-defense have long been concerned with ways in which such weapons could appropriately be concealed in articles of ordinary clothing in a safe manner and yet be readily be available in emergencies.

One means which has been devised to conceal a knife within a belt is to fashion the buckle of the belt into a handle for the knife. The buckle is then extended to form a knife blade which is inserted into a leather holster formed on or in the nearest belt end. The buckle-knife combination is engaged by a pin and hole arrangement with the nearest belt end or some other means by affixing the knife to the belt end. The opposing belt end is then threaded through the knife-buckle combination to form and function as what appears to be an ordinary belt buckle.

This kind of concealed weapon has several drawbacks. Firstly, the belt must be taken off or at least unbuckled before the weapon can be withdrawn. Secondly, the means whereby the knife-belt combination is attached to the nearest belt end must be uncoupled before the knife-buckle can be withdrawn from the belt for use. Thirdly, the knife is concealed solely in the leather end of the belt, which may have one or more layers added for thickness, and relies solely upon the strength and impenetrability of the leather in order to safely retain the knife.

This prior art construction is unsafe, unwieldy and of impractical utility when used as a defensive weapon. Very often, the victim is overtaken by an aggressor of superior size and strength who may leave the victim with little opportunity or time in which to undertake any defensive action. What is needed then, is an article of apparel for concealing a weapon which includes a means for safely retaining the weapon within the article and yet allows for a quick withdrawal without the necessity of interfering with or being delayed by the function of the article, such as unbuckling a belt.

BRIEF SUMMARY OF THE INVENTION

The present invention is an article of apparel or clothing which is configured and arranged to carry a concealed weapon. The article comprises a holster means or case having a first curvature. The holster means serves to conceal and engage, at least in part, the weapon. The article also includes a weapon which has, at least in part, a second curvature which differs from the first curvature of the holster.

By reason of these differing curvatures, the weapon and holster means are frictionally and securely engaged which allows the weapon to be withdrawn quickly and simply.

In the presently preferred embodiment the article of apparel is a belt and the holster means includes a buckling means for buckling the belt together. The buckling means is coupled to the holster means in such a manner that it is solely engaged therewith and it does not engage the weapon. This allows the weapon to be withdrawn from the belt without attempting to unbuckle or manipulate the belt in anyway.

In the presently preferred embodiment, the holster means is resilient and the weapon is relatively rigid. One end of the weapon may include an engagement means for increasing the frictional engagement between the holster means and the weapon. In one embodiment, this engagement means may be an end clip which is configured to clip over one end of the holster means thereby drawing the resilient holster means towards the weapon. In another embodiment, the engagement means is a protrusion formed in the weapon and configured to contact the holster means to push the resilient holster means away from the weapon, whereby the frictional contact is increased.

The present invention and its various embodiments may be better understood by reviewing the detailed description in light to the following figures.

DETAILED DESCRIPTION OF THE PREFERRED EMBODIMENTS

The present invention is a belt for carrying a quick-draw knife which is comprised of a holster having a first curvature and a knife having, at least in part, a second curvature which is unequal or different than the first curvature. By virtue of these differing curvatures, the knife can be securely held in the holster by frictional contact therewith, and yet be quickly withdrawn by a single, simple movement. In one embodiment the holster also includes means for buckling the belt whereby the means is coupled solely to the holster so that the belt remains buckled even when the knife is withdrawn. These and other embodiments of the present invention can better be understood by viewing FIG. 1.

Figure 1:
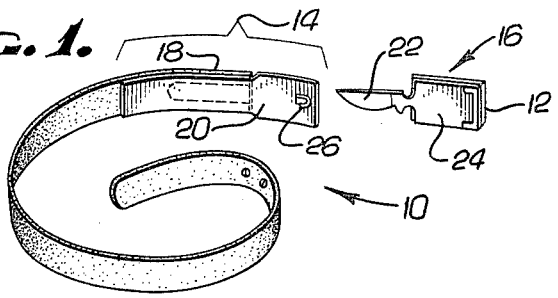
FIG. 1 is a perspective view of a belt shown from the rear in which the knife is withdrawn.

FIG. 1 is a rear perspective view of a belt 10 in which a knife, which is generally denoted by the reference character 16, has been withdrawn. Knife 16 is concealed within portion 14 of belt 10. In the illustrated embodiment, a portion of knife 16 is shown as a decorative buckle 12, although as will be made clear below, buckle 12 is purely decorative insofar as the functioning of the belt is concerned. Section A—A is a cross-section taken through the midline of belt 10 and knife 16, and buckle 12.

Figure 2:
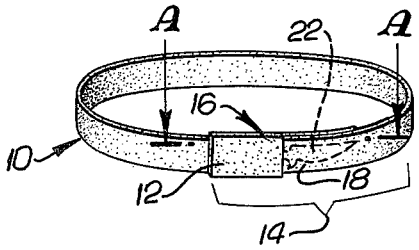
FIG. 2 is a perspective view of the belt from the front in which a knife has been concealed according to the present invention.

FIG. 2 is a front perspective view of the belt of FIG. 1 wherein knife 16 has been concealed within portion 14 of belt 10.

Figure 3:
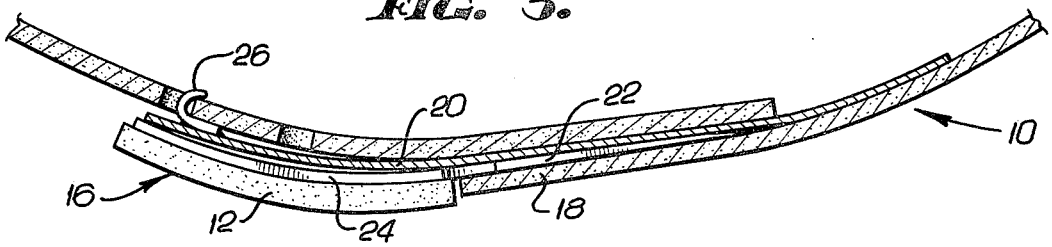
FIG. 3 is a cross-sectional view of the knife in FIG. 1 taken through section A—A showing engagement of the knife and holster arising by virtue of their differing curvatures.

FIG. 3 shows the cross-section taken from section A—A. Belt 10 includes an end portion or sheath 18 which is coupled or disposed on a metal plate 20. Plate 20 has a first curvature which is usually approximated by the natural curvature of the waist of the wearer. Leather portion 14 in the illustrated embodiment is bonded by means of an epoxy to plate 20 and has a hollowed portion provided therein for receipt of knife 16. A blade portion 22 is inserted within the appropriately hollowed portion of sheath 18. Knife 16 is extended to form a handle portion 24 which may be integral with or coupled to buckle 12. Buckle 12 is of such a size and shape as to conveniently function as the knife handle and to facilitate withdrawal of the knife and its use. It is contemplated within the present invention that the shape and form of blade 22, handle 24, and buckle 12 may assume many well known and decorative shapes as may be well known to the art and desired for the particular application.

FIG. 3 illustrates in simplified form the means of frictional engagement between knife 16 and holster portion 14 of belt 10. In FIG. 3, knife 16 is shown as formed with a second curvature while plate 20 is formed with a first curvature. The second curvature of knife 16 is slightly more accute or accentuated than that of plate 20. When knife 16 is snuggly fitted within sheath portion 18, plate 20, and knife 16 are pressed closely together. Although it is included within the scope of the present invention that the knife may be resilient, in whole or in part, the illustrated embodiment shows a resilient plate 20 and sheath 18. Therefore, plate 20 and sheath 18 are deformed to assume the curvature of the knife 16. Plate 20 resiliently presses against the knife 16 thereby securely retaining it within holster portion 14. Knife 16 may be curved in whole or in part. FIG. 3 shows the handle portion 24 being curved while blade portion 22 is straight. It is within the scope of the present invention that the curvature of the knife may be oppositely distributed between the handle and blade portion or may be entirely curved.

FIG. 3 also illustrates a buckling means or a hook 26 extending from and integral with plate 20. The opposite belt end is extended across the back of plate 20 and is engaged by hook 26 which is inserted through a hole provided in the opposite belt end, as is well known to the art. Many other buckling means, as are well known, may also be employed. However, it is noted that in the present invention buckling means 26 is coupled only to plate 20 and in no way is coupled to, attached or interferes with the engagement of knife 16 or the movement of knife 16 into or out of concealment. Thus, knife 16 can be quickly withdrawn without the necessity of manipulating or interfering with the functioning of the belt or buckle in any manner.

Figure 4:
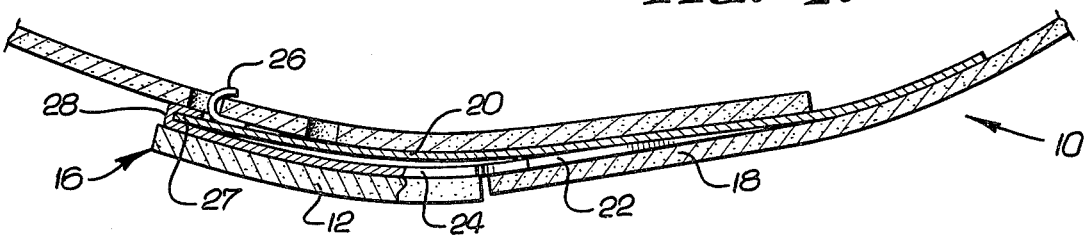
FIG. 4 is a cross-sectional view taken through section A—A of FIG. 1 of another embodiment of the present invention wherein the knife is provided with an end clip which draws the holster towards the knife in order to increase frictional engagement.

FIG. 4 shows yet another embodiment of the present invention wherein knife 16 is provided with an end engagement means or end clip 28. End clip 28 may be welded to or integrally formed as part of handle portion 24 of knife 16. End clip 28 is arranged and configured to extend over end 27 of plate 20. Since in the illustrated embodiment plate 20 is assumed to be the more resilient member as between plate 20 and knife 16, end clip 28 engages end 27, which may have a local curvature which is more accute or accentuated than knife 16, to draw end 27 toward handle 24. Notwithstanding this, the remaining portion of plate 20 may have less of an accute curvature than knife 16 to permit the plate to knife engagement described in FIG. 3. As previously stated, it is also within the scope of the present invention that curvature of knife 16 may be less than curvature of plate 20. In that case, holster portion 14 presses knife 16 against plate 20 thereby tending to straighten or bend plate 20 to the curvature of knife 16. End clip 28 in such instance, facilitates this by clipping end 27 closely to knife 16 to provide increased frictional engagement. Detail of end clip 28 is shown in FIG. 1, showing in the illustrated embodiment that clip 28 engages the entire end edge and side portions of end 27 of plate 20.

It is also within the scope of the present invention that blade portion 22 of knife 16 may be straight while handle portion 24 of knife 16 may have a curvature equal to that of plate 20. However, the effective average curvature of knife 16 would be less than that of plate 20 due to the straight portion of blade 22, thereby providing the type of frictional engagement illustrated in FIG. 4.

Figure 5:
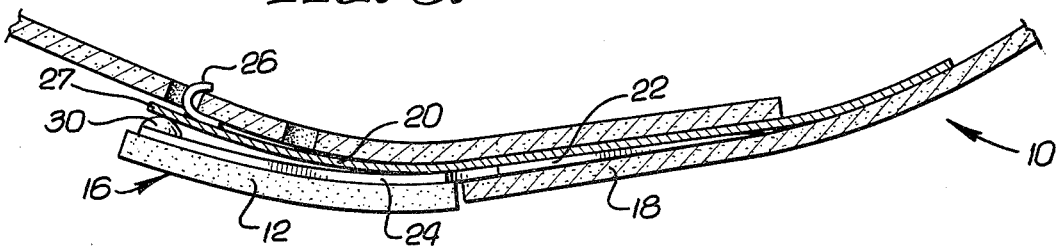
FIG. 5 is another embodiment of the present invention taken through section A—A showing a protrusion provided at one end of the knife to push the holster away from the knife, thereby increasing frictional engagement.

FIG. 5 illustrates yet another embodiment of the present invention wherein knife 16 is provided with a protrusion 30 which contacts end 27 of plate 20 to push plate 20 away from knife 16. While it is possible that protrusion 30 may be used in an embodiment where plate 20 has a more acute curvature than the average curvature of knife 16, it is contemplated in the embodiment of FIG. 5 that protrusion 30 would be of greatest advantage when knife 16 has a curvature greater than that of plate 20. Thus, if plate 20 is pressed against knife 16 as it is inserted within sheath 18 the frictional contact will be increased as resilient plate 20 is further deformed beyond the curvature of knife 16 by virture of protrusion 30.

Figure 6:
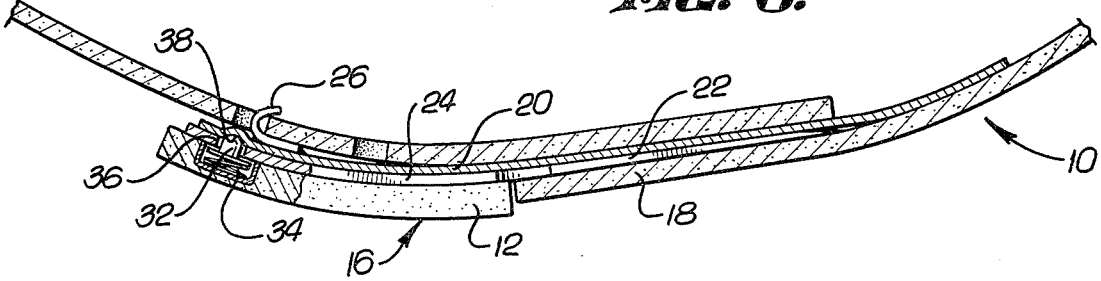
FIG. 6 is yet another embodiment of the present invention taken through section A—A of FIG. 1 wherein a ball and detent depression are provided in the knife and holster combination to increase the frictional engagement.

FIG. 6 illustrates another embodiment of present invention wherein end clip 28 and protrusion 30 are replaced by a spring loaded ball 32 and a detent depression 38. In the illustrated embodiment ball 32 is shown as disposed within a cyclindrical hole 36 provided in handle 24 of knife 16 and as pressed outwardly by spring 34. An appropriately formed lip in handle 24 retains ball 32 within hole 36. A mating detent depression 38 is provided in plate 20 so that, when plate 20 and knife 16 are properly engaged, ball 32 will snap into depression 38, thereby providing increased frictional contact between plate 20 and knife 16. However, it is again understood that the frictional contact between the differing curvatures of knife 16 and plate 20 may also be employed in addition to the enhancement provided by ball 32 to provide the secure frictional engagement between knife 16 and holster portion 14 of belt 10.

Many other alterations and modifications well known to the art may be made to the present invention without departing from its spirit and scope. The presently illustrated embodiments were shown for the purposes of description and clarity and are not intended to limit the scope or meaning of the claims.

I claim:

1. An article of apparel being configured and arranged to carry a concealed weapon, said article comprising:

holster means included within said article of apparel, said holster means having a first curvature in a longitudinal direction, said holster means for concealing and engaging, at least in part, said weapon; and a weapon having an elongated blade portion, said blade portion having, at least in part, a second curvature along said longitudinal direction differing from said first curvature, the elongation of said blade portion being generally in said longitudinal direction, said weapon being disposed within said holster means and frictionally retained therein by the difference in said first and second curvatures along said longitudinal direction, whereby said weapon and holster means are frictionally, securely engaged and whereby said weapon can be withdrawn for use quickly and simply.

2. The article of claim 1 wherein said weapon includes on one end thereof an engagement means for increasing frictional engagement between said holster means and said weapon.

3. The article of claim 2 wherein said engagement means is an end clip, said end clip configured to clip over an end of said resilient holster means to draw said resilient holster means toward said weapon thereby increasing frictional engagement therebetween.

4. An article of apparel being configured and arranged to carry a concealed weapon, said article comprising:

holster means having a first curvature, said holster means for concealing and engaging, at least in part, said weapon; and a weapon having, at least in part, a second curvature differing from said first curvature, wherein said weapon includes on one end thereof an engagement means for increasing frictional engagement between said holster means and said weapon, and wherein said engagement means includes a spring loaded ball configured to engage a detent depression, whereby said weapon and holster means are frictionally, securely engaged and whereby said weapon can be withdrawn for use quickly and simply.

5. The article of claim 4 wherein said spring loaded ball is disposed within said weapon and said detent depression is disposed in said holster means.

6. An article of apparel being configured and arranged to carry a concealed weapon, said article comprising:

holster means having a first curvature, said holster means for concealing and engaging, at least in part, said weapon; and a weapon having, at least in part, a second curvature differing from said first curvature, wherein said holster means is comprised of:

a curved metallic plate; and a pliable sheath disposed at least in part on said plate and having a space defined therebetween for insertion and concealment of said weapon whereby said weapon and holster means are frictionally, securely engaged and whereby said weapon can be withdrawn for use quickly and simply.

7. A belt for carrying a quick-draw knife comprising:

a holster for receiving a blade, said holster having a first curvature as defined by a metallic plate; and a knife having a blade, said blade having at least in part, a second curvature unequal to said first curvature, said knife being disposed in said holster and having a handle simulative of a belt buckle, said knife being retained in said holster by frictional engagement therewith due to the inequality of said first and second curvatures, whereby said knife can be securely held in said holster by frictional contact and yet be quickly withdrawn by a single, simple movement.

8. The belt of claim 7 wherein said knife is resilient.

9. The belt of claim 7 or 8 wherein said knife has a handle portion, said portion having said second curvature.

10. The knife of claim 7 wherein said knife has an end clip for engaging said metallic plate at one end to draw said plate and knife together, whereby frictional engagement is increased.

11. A belt for carrying a quick-draw knife having a handle simulative of a belt buckle and an elongated blade being elongated along a longitudinal direction comprising:

a flexible belt strap;

a metal plate, having a first curvature in said longitudinal direction, coupled to a first end of said belt strap, and defining a holster pocket therebetween;

buckle means for coupling said plate to a second end of said belt strap;

a knife having said blade disposed in said holster pocket, said blade having a second curvature in said longitudinal direction, said first and second curvatures being unequal, whereby said knife is frictional retained in said belt by the difference in the longitudinal curvatures.

12. The belt of claim 11 wherein said plate is resilient and said handle includes means for engaging said resilient plate and deforming said first curvature of said plate to increase frictional retention thereby.

* * * * *